US006151854A

United States Patent [19]

Gutjahr

[11] Patent Number: 6,151,854

[45] Date of Patent: Nov. 28, 2000

[54] PROFILED WEB FOR VENTING AND DRAINING FLOOR TILES, PARTICULARLY CERAMIC TILES, LAID IN A THIN RETAINING LAYER

[76] Inventor: Walter Gutjahr, Darmstädter Strasse 3a, D-64404 Bickenbach, Germany

[21] Appl. No.: 09/105,371

[22] Filed: Jun. 26, 1998

[30] Foreign Application Priority Data

Jul. 24, 1997 [DE] Germany ..... 297 13 161
Apr. 9, 1998 [DE] Germany ..... 298 06 561

[51] Int. Cl.[7] ..... E04F 13/08; E04F 15/16

[52] U.S. Cl. ..... 52/385; 52/388; 52/389; 52/450; 52/454

[58] Field of Search ..... 52/344, 385, 388, 52/389, 390, 443, 449, 450, 454

[56] References Cited

U.S. PATENT DOCUMENTS

| | | | |
|---|---|---|---|
| Re. 21,285 | 12/1939 | Desagnat | 52/388 |
| 764,989 | 7/1904 | Chester | 52/450 |
| 5,052,161 | 10/1991 | Whitacre | 52/385 |
| 5,137,764 | 8/1992 | Doyle et al. | 52/390 X |
| 5,259,157 | 11/1993 | Ault | 52/450 X |
| 5,927,033 | 7/1999 | Kreckl | 52/390 |

FOREIGN PATENT DOCUMENTS

| | | |
|---|---|---|
| 8311020 | 7/1983 | Germany . |
| 3527570 | 2/1987 | Germany . |
| 9001470 | 8/1990 | Germany . |
| 9001875 | 8/1990 | Germany . |

*Primary Examiner*—Carl D. Friedman
*Assistant Examiner*—Kevin D. Wilkens
*Attorney, Agent, or Firm*—Norris, McLaughlin & Marcus P.A.

[57] ABSTRACT

A profiled web for arrangement between the underside of floor tiles and an upper surface of a support plate. The profiled web is based on a rigid plastic film formed to have a parallel series of successive channels, each of the channels being defined by first and second edge portions and a trough portion therebetween. The series of channels are open alternately to the upper surface of the support plate as a first group of channels and to the underside of the floor tiles when in an installed position as a second group of channels. First trough portions of the channels open to the support plate are parallel, and form an upper surface of the web; second trough portions of the channels open to the tiles are parallel and form a lower surface of the web. The web is provided with a plurality of through-openings which produce a liquid- and gas-permeable connection between successive channels. A liquid- and gas-permeable textile mesh is adhesively laminated to the upper surface of the web and extends across successive channels in the form of a plane. In an alternate embodiment, a supporting profile strip is located in transverse orientation to the channels, at the longitudinal ends of the channels.

33 Claims, 2 Drawing Sheets

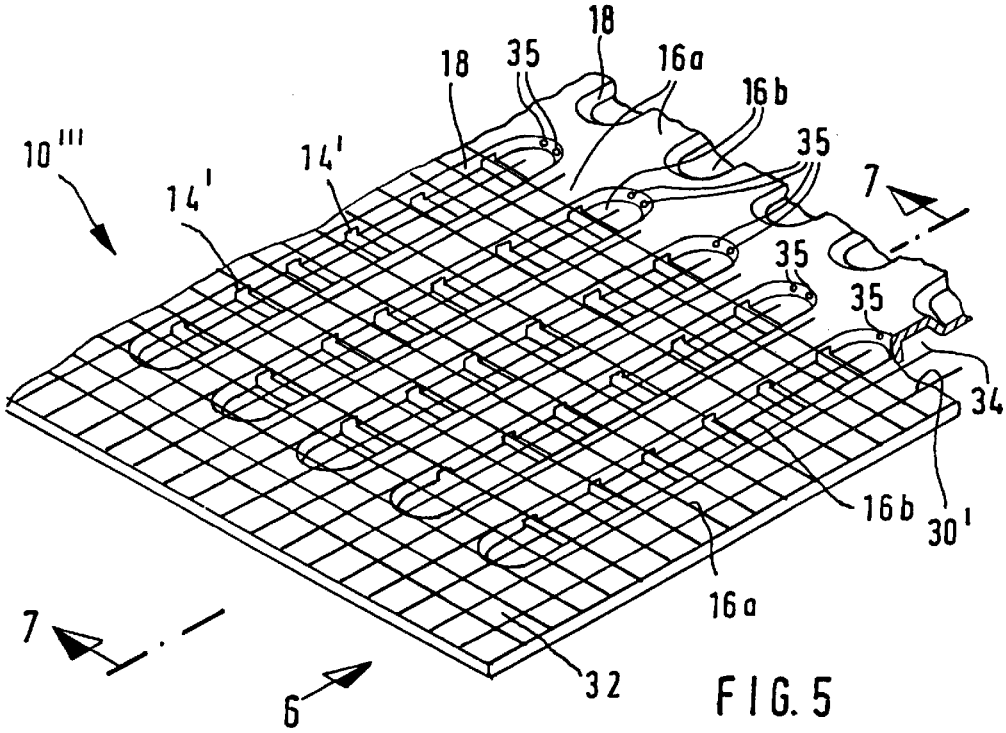
FIG. 5
FIG. 6
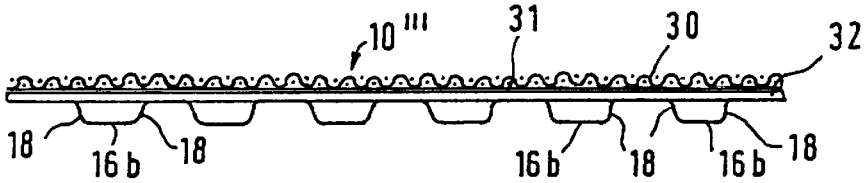
FIG. 7
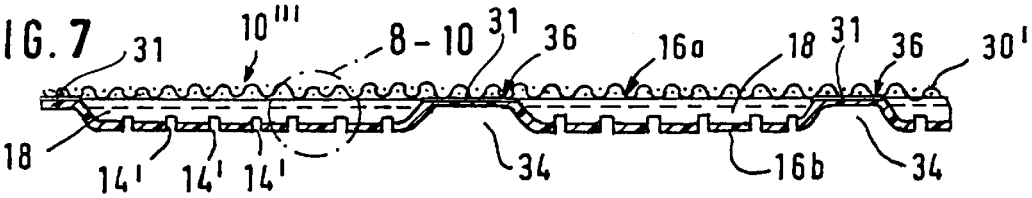
FIG. 8
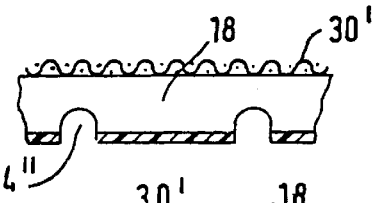
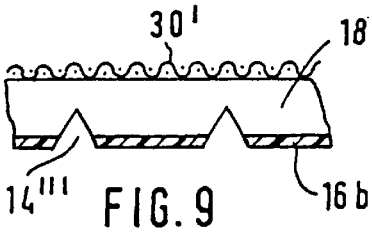
FIG. 9
FIG. 10
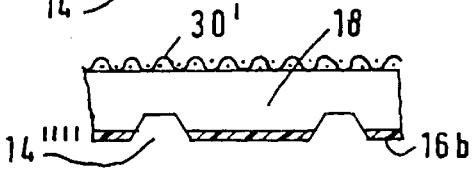

PROFILED WEB FOR VENTING AND DRAINING FLOOR TILES, PARTICULARLY CERAMIC TILES, LAID IN A THIN RETAINING LAYER

BACKGROUND OF THE INVENTION

The invention relates to a profiled web for arrangement between the underside of floor tiles, such as ceramic tiles or the like, to be laid on a support plate in a thin retaining layer and the upper surface of the support plate comprising an inherently rigid plastic film which is so profiled by closely spaced, parallel, strip-shaped successive sections, which are so deformed, preferably turned over or folded, in the opposite sense to the preceding strip-shaped section, that channels are produced which are open alternately to the support plate and to the underside of the floor tiles.

The upper surface of the substrates of balconies or terraces subjected to atmospheric influences, i.e. in general concrete support plates, which are to be laid with tiles, preferably ceramic tiles, are increasingly sealed by means of sealing slurries or so-called liquid films. Spaces in the thin mortar layer beneath the ceramic lining cannot be precluded. If leaking water flows into the spaces via the joints in the tile covering frost spalling frequently occurs on glazed ceramic tiles. Furthermore, water trapped in such spaces expands so that the ice which forms results in the ceramic tile covering being cracked away from the thin retaining mortar layer.

SUMMARY OF THE INVENTION

It is the object of the invention to make the laying of particularly ceramic tiles possible in a thin retaining layer on substrates whose upper surface is sealed by alternative seals, such as sealing slurries or a liquid film, against the penetration of water without there being the risk of frost spalling on the tiles or the forcing of the ceramic coverings away from the thin retaining mortar layer.

Starting from a profiled web of the type referred to above, this object is solved in accordance with the invention if the plastic film is provided, at least in regions, with a plurality of through openings which produce a liquid- and gas-permeable connection of the channels open to the upper surface with the underside, particularly the channels open to the underside. When laying tile coverings using the film in accordance with the invention, one can proceed such that the profiled web is placed loosely on the upper surface of the sealed support plate and then the floor tiles, particularly ceramic tiles, are applied adhesively onto the profiled web by means of a thin adhesive retaining layer, such as tile adhesive, a thin retaining mortar layer or the like. The profiled web is thus only loosely placed on the sealing layer of the substrate and can thus not transmit any shear forces to damage the sealing layer, i.e. the tile covering is decoupled from the substrate. Water penetrating into the thin retaining mortar layer through the joints of the ceramic tiles can pass or diffuse through the thin retaining mortar layer to the profiled web and be drained to the lowest point, particularly by means of the channels formed in the underside. Residual moisture still contained in the thin retaining mortar layer is dried by means of the air gaining access via the passages and the through openings.

The through openings can be provided in the strip-shaped sections defining the lateral boundary walls of the channels and/or the strip-shaped sections defining the lateral boundary walls of the channels and/or the strip shaped sections which are opposed to the open mouth of the channels and (thus) define of the base of the channel in question.

The through openings are conveniently constituted by a pattern of stamped openings formed regularly or irregularly in the plastic film which is still flat before the profiling of the profiled web. The openings which are optionally present in the strip-shaped sections defining the lateral boundary walls of the channels can have different shapes in the passage direction, that is to say particularly rectangular, archway shaped, triangular or trapezoidal and can be formed by stamping or milling from the underside of the profiled web.

The strip-shaped sections defining each channel base are preferably of flat construction in order to transmit the weight forces acting on the tile covering as uniformly as possible into the substrate by virtue of a large area support of the film on the seal on the support plate and also a large area connection with the thin layer of mortar. A substantially flat profile strip extending transversely to the channels can advantageously be provided at the transverse ends of the channels defined by the strip-shaped sections, which profile strip additionally reinforces the profiled web. It can be convenient, depending on the application, to construct this profile strip so that it forms a flat unit either with the sections defining the bases of the channels open to the underside or with the sections defining the bases of the channels open at the upper surface, whereby a larger engagement surface is produced which reduces the pressure in the edge region.

The profiled web is preferably so constructed that the strip-shaped sections defining each channel base and those subsequent sections defining the channel side walls extend at right angles to one another. Each individual channel thus has a U section.

Alternatively, the strip-shaped sections defining each channel base and the strip-shaped sections defining the adjoining channel side walls can extend at an angle of less than 90° to one another, whereby a swallow tail-shaped profiling is then produced with respect to each individual channel.

Finally, it is also possible to construct the strip-shaped sections defining each channel base and the strip-shaped sections defining the adjoining channel side walls so that they extend at an angle of more than 90° to one another.

In an advantageous embodiment of the invention the channels which are open upwardly in the predetermined installation state of the profiled web are each interrupted at at least one and preferably a plurality of positions by transverse channels open to the underside. These transverse channels have the advantageous effect that mortar or the like penetrating into the upwardly open channels during laying of the tiles does not form a long continuous mortar strip extending over the entire breadth of the profiled web after it has set in the upper channels, the coefficient of expansion of which mortar strip differs from that of the tiles laid thereon or of the profiled web, but instead only short mortar strips form in the upwardly open channels which are interrupted by the transverse channels. The arching of the profiled web or lifting away of the applied tile covering which is observed with long continuous channels is thus prevented.

The transverse channels are preferably so constructed that their upper surfaces define a plane with the upper surfaces of the sections defining the bases of the channels which are open to the underside and thus advantageously increase the engagement surface for the tiles. It is then possible to provide small, water permeable flow openings from the channels open in the upper surface to the transverse channels so that—particularly if there is a substantial influx of permeating water—the water can also be drained away transversely to the channels which are open to the underside.

Furthermore, if there is a locally limited, substantial water inflow, water can flow over from one channel which is open at the underside and has reached its drainage capacity limit into the transverse channels and into an adjoining channel. It can be ensured by the dimensioning of the optionally provided flow openings that indeed only water, but not the mortar or the like which is still liquid during laying of the tiles, flows into the transverse passages and thus destroys the advantageous drainage effects described above.

The plastic film of the profiled web is as thin as possible but is selected to be so inherently rigid that the profiled web may be rolled up whilst being elastically deformed.

In an advantageous embodiment of the invention a liquid- and gas-permeable textile mesh or the like can additionally be firmly adhesively laminated onto the upper surface of the profiled web directed towards the floor tiles. The tile adhesive or thin mortar layer introduced into the upwardly open channels encases the open reticulated textile mesh which, after setting of the adhesive or mortar, then serves as reinforcement for the adhesive or mortar layer. A thin retaining connecting layer which is cohesive and significantly less subject to cracking is thus provided between the profiled web and the covering of floor tiles.

A glass textile mesh is preferably used as the textile mesh, e.g. a glass textile mesh with a tear strength between 4000 and 6000 kg/lfd.m. In practice, a glass textile mesh with a tear strength of 4800 kg/lfd.m has proved to be particularly satisfactory which is firmly adhesively attached to the profiled web by adhesive.

BRIEF DESCRIPTION OF THE DRAWINGS

The invention will be explained in more detail in the following description of exemplary embodiments in conjunction with the drawings, in which:

FIG. 5 is a perspective view of a portion of a fourth exemplary embodiment of a profiled web in accordance with the invention;

FIG. 6 is a side view of the profiled web of FIG. 5, seen in the direction of the arrow 6 in FIG. 5;

FIG. 7 is a sectional view of the same profiled web along the line 7—7 in FIG. 5; and FIGS. 8 to 10 show three different shapes of openings formed in the side walls of the channel.

DETAILED DESCRIPTION OF THE INVENTION

Figure 1:
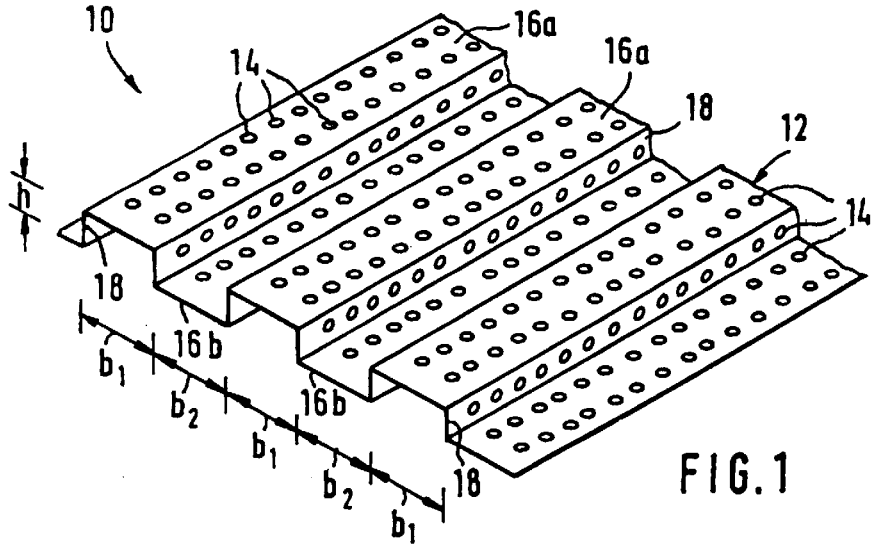
FIG. 1 is a perspective view of a section of a first exemplary embodiment of a profiled web in accordance with the invention.

A first exemplary embodiment of a profiled web 10 in accordance with the invention is shown in FIG. 1. The profiled web comprises an originally flat, thin, stiff plastic film 12, which is provided overall with a plurality of stamped openings 14, which are circular in the illustrated exemplary embodiment and are arranged in a regular or irregular pattern, and is so profiled in the manner visible in the figure by alternating right-angled bending over of strip-shaped sections 16*a*, 18, 16*b* in opposite directions that U section channels are defined which are open successively to the upper surface, i.e. to a tile covering which is to be laid, and to the underside, i.e. to the seal of a substrate, e.g. a concrete support plate or an additionally provided floor finish.

The plastic film 12 used as the starting product can be relatively thin, i.e. have a material thickness of e.g. only 0.5 mm. The height or depth h of the parallel channels may be, for instance, of the order of 4 to 5 mm whilst the channel breadths b1, b2 can be of the order of 8 to 10 mm. The breadth of the successive downwardly and upwardly open channels b1 and b2, respectively, can be either the same or—in special cases—different.

Figure 2:
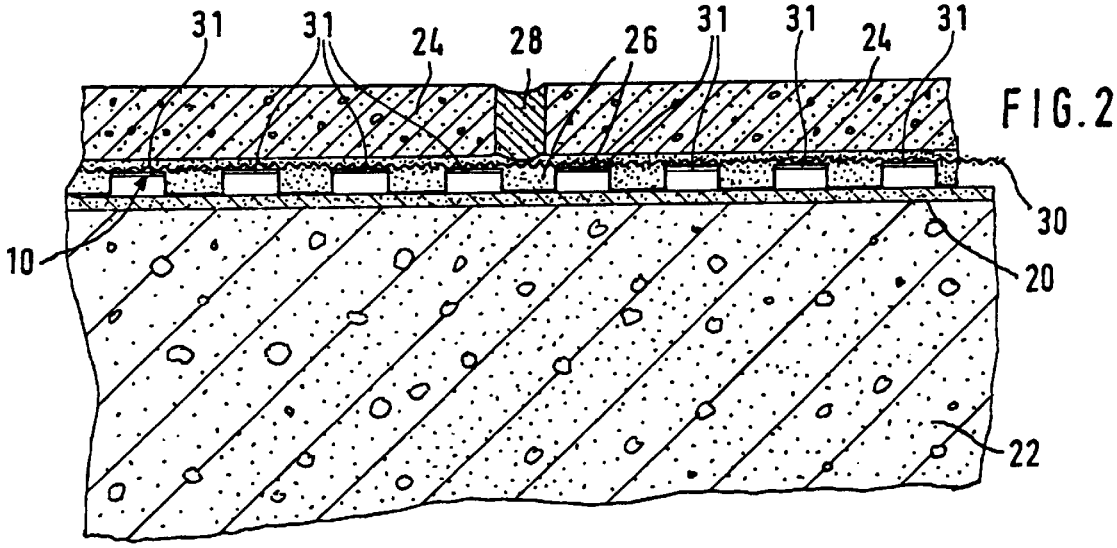
FIG. 2 is a vertical sectional view of a tile covering laid on a concrete support plate by means of the profiled web shown in FIG. 1.

FIG. 2 shows the profiled web 10 described above in conjunction with FIG. 1 placed on a sealing layer 20, constituted, for instance, by a hardened sealing slurry, on a concrete support plate 22. Flooring of ceramic tiles 24 is firmly adhesively applied by means of a tile adhesive layer 26 to the strip-shaped sections 16*a* constituting the bases of the downwardly open channels, which adhesive layer also engages in the channels which are open upwardly, i.e. towards the tiles 24. The joints between the tiles 24 are then filled in the usual manner by means of a porous setting joint composition 28.

It will be clear that rain water infiltrating through the joint composition 28 can pass through to the profiled web 10 and then can pass through to the sealing layer 20, either directly via an upwardly open channel or via the stamped opening 14 into a downwardly open channel. Liquid water droplets can then be drained to the lowest point following an inclination of the upper surface of the support plate 22 whilst water vapour and water which is still contained in the capillaries in the tile adhesive layer 26 or a thin retaining mortar layer, which is optionally present, can flow away or be dried as a result of the access of air via the channels and vented away.

Figure 3:
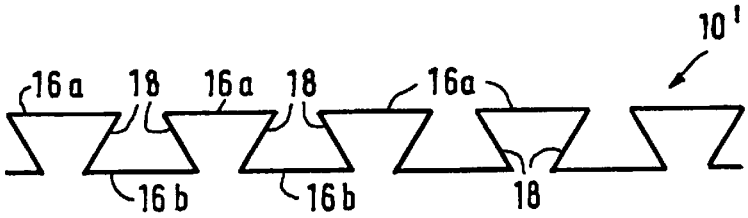
FIG. 3 is a sectional view of a portion of a second exemplary embodiment of a profiled web in accordance with the invention with swallow tail-shaped undercut channels.

A profiled web 10' is shown schematically in FIG. 3 which differs from the profiled web 10 described with reference to FIG. 1 only in that the strip shaped sections 18 do not define an angle of 90° with the adjacent strip-shaped sections 16*a*, 16*b* but an angle of less than 90°. The recognisable swallow tail-shaped profiling is thus produced.

Figure 4:
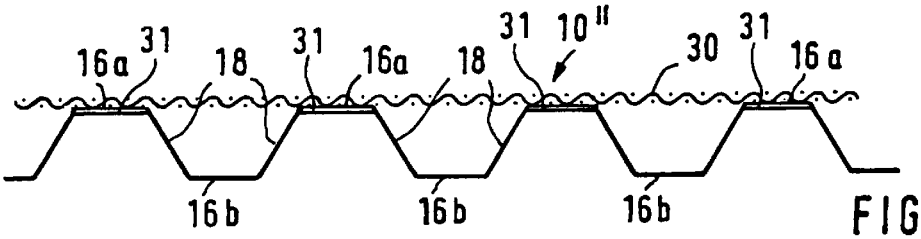
FIG. 4 is a sectional view of a third exemplary embodiment of a profiled web in accordance with the invention with a trapezoidal channel cross-section, a textile mesh being laminated onto the upper surface directed towards the tile covering.

Finally, a profiled web 10" is shown in FIG. 4 in which the angle between the successive strip shaped section 16*a*, 18, 16*b* is greater than 90° so that the channels which may be seen in FIG. 4, with a trapezoidal cross-section are produced. A decomposition-resistant, liquid- and gas-permeable textile mesh 30 is additionally shown in this figure adhesively laminated (as at 31) onto the strip shaped section 16*a* which is directed upwardly, i.e. towards the tile covering. This textile mesh stabilises the channels of the profiled web 10". Within the thin adhesive or mortar retaining layer, which also penetrates through the textile mesh into the upwardly open channels, this textile mesh constitutes reinforcement after setting of the thin retaining layer which inhibits the formation of cracks in the thin retaining mortar layer or the tile adhesive and can thus significantly increase the service life of the tile covering.

In the profiled web 10''' shown in FIGS. 5 to 7, a profile strip 32, which extends transversely to the channels and is substantially flat, is provided at the transverse ends of the channels defined by the strip shaped sections 16*a*, 18, 16*b*

(of which only a few are provided with reference numerals for reasons of clarity). This profile strip 32 constitutes a flat unit together with the sections 16*a* defining the bases of the channels which are open to the underside.

A glass textile mesh 30' with a tear strength of about 4800 kg/lfd.m is laminated onto the profiled web 10'''.

As may be seen in FIG. 7, the upwardly open channels defined by the sections 16*b* and 18 are interrupted at a plurality of points by transverse channels 34 which intersect the channels which are open to the underside so that water can cross over out of them into the transverse channels. The upper surfaces 36 of the transverse channels 34 define a plane with the upper surfaces of the sections 16*a* defining the bases of the channels which are open to the underside. Furthermore, small water permeable flow openings 35 can be provided in the side walls of the transverse passages 34 which enable water to flow from the upwardly open channels directly into the transverse channels 34. As indicated in FIG. 7 by the chain-dotted circle designated 8 to 10, different shapes of through openings formed in the strip shaped sections 18 defining the lateral boundary walls of the channels are shown on an enlarged scale in FIGS. 8 to 10, though the openings 14' which are shown in FIGS. 5 and 7 and are rectangular when viewed in the passage direction have not been shown again. Instead, alternative shapes of opening are shown, namely an archway-shaped opening 14'' in FIG. 8, a triangular opening 14''' in FIG. 9 and a trapezoidal opening 14'''' in FIG. 10, seen in each case in the passage direction. All these openings can be formed by stamping, boring, cutting or milling, whereby it is possible—as may be seen in FIGS. 5 and 7 to 10—when forming the openings in the sections 18 defining the channel side walls to cut or mill the sections 16*b* defining the lower channel base at the same time so that the openings 14' to 14''' in these exemplary embodiments extend from one channel side wall 18 over the channel base 16*b* to the next channel side wall. Since the channel base 16*b* rests on the seal in the predetermined installed state, these regions of the openings 14' to 14'''' provided in the channel base 16*b* do not substantially increase the drainage capacity but do permit the outlined simple production of the openings by milling in from the underside and also save material and weight.

It will be clear that modifications and developments of the described exemplary embodiments may be realised within the scope of the inventive concept. Thus the values of the film thickness, the height or depth of the channels and their breadth in the description of the profiled web illustrated in FIG. 1 are to be understood as being only exemplary values which are not intended to exclude other dimensions. In particular, the channels can also have significantly greater depth or height and/or breadth dimensions. The stamped openings 14 can—in distinction from the representation in FIG. 1—also be of slit, polygonal or other shape. Of importance is only that the passage of liquid or gas or water vapour through the profiled web can occur via the openings 14, . . . 14''''. A textile mesh 30 can also be laminated onto the upper surface of the profiled webs 10 and 10' shown in FIGS. 1 and 3 in order to produce the advantageous reinforcing effect which inhibits the formation of cracks described in conjunction with the profiled web 10''. Such a textile mesh 30 or 30' is shown laminated onto the profiled web 10 or 10''' in FIGS. 2 and 5. The production of the channels can on the one hand be effected by alternately bending over strip shaped regions of the originally flat film web in opposite directions. Alternatively, the channels open at the upper surface can also be produced by deep drawing or hot embossing in the originally flat film web, whereby the formation of the lateral flat profile strips 32 and of the transverse channels 34 is possible in a manner corresponding to the exemplary embodiments shown in FIGS. 5 to 7.

What is claimed is:

1. A profiled web for arrangement between the underside of floor tiles and an upper surface of a support plate, the profiled web comprising a rigid plastic film formed to comprise a parallel series of successive channels, each of said channels being defined by first and second edge portions and a trough portion therebetween, the series of channels open alternately, as a first group of channels, to the upper surface of the support plate when in an installed position, and as a second group of channels to the underside of the floor tiles when in an installed position, trough portions of the channels open to the support plate when in an installed position being parallel and forming an upper surface of the web, and trough portions of the channels open to the tiles when in an installed position being parallel and forming a lower surface of the web, wherein the web is provided with a plurality of through-openings which produce a liquid- and gas-permeable connection between successive channels, and a substantially flat profile strip, extending transversely to the channels, adjacent longitudinal ends of the channels.

2. Profiled web as claimed in claim 1, wherein the through-openings are constituted by a pattern of stamped openings provided in the film.

3. Profiled web as claimed in claim 1, wherein the through-openings have a shape of an arch when viewed in a direction through the through-openings.

4. Profiled web as claimed in claim 1, wherein the through-openings are of triangular shape when viewed in a direction through the through-openings.

5. (Profiled web as claimed in claim 1, wherein the through-openings are of trapezoidal shape when viewed in a direction through the through-openings.

6. Profiled web as claimed in claim 1, wherein the trough portions are of flat construction.

7. Profiled web as claimed in claim 1, wherein the flat profile strip forms a flat co-planar unit with the first trough portions.

8. Profiled web as claimed in claim 1, wherein the first and second edge portions of each trough portion extend at right angles thereto.

9. Profiled web as claimed in claim 1, wherein the first and second edge portions of each trough portion extend at an angle of less than 90°.

10. Profiled web as claimed in claim 1, wherein the first and second edge portions of each trough portion extend at an angle of more that 90° thereto.

11. Profiled web as claimed in claim 1, wherein a liquid- and gas-permeable textile mesh is adhesively laminated on the upper surface of the web, and extends across successive channels in the form of a plane.

12. Profiled web as claimed in claim 11, wherein the textile mesh is a glass textile mesh.

13. Profiled web as claimed in claim 12, wherein the glass textile mesh has a tear strength between 4000 and 600 kg/lfd.m.

14. Profiled web as claimed in claim 1, wherein channels in the second group of channels are interrupted by transverse channels open to the underside facing the support plate when in an installed position.

15. Profiled web as claimed in claim 14, wherein upper surfaces of the transverse channels are situated in a plane with the upper surfaces of the second trough portions.

16. Profiled web as claimed in claim 14, wherein water-permeable flow openings are provided connecting the first group of channels to the transverse channels.

17. A profiled web for arrangement between the underside of floor tiles and an upper surface of a support plate, the profiled web comprising a rigid plastic film formed to comprise a parallel series of successive channels, each of said channels being defined by first and second edge portions and a trough portion therebetween, the series of channels being open alternately to the upper surface of the support plate as a first group of channels and to the underside of the floor tiles when in an installed position as a second group of channels, first trough portions of the channels open to the support plate when in an installed position being parallel and forming an upper surface of the web, and second trough portions of the channels open to the tiles when in an installed position, being parallel and forming a lower surface of the web, wherein the web is provided with a plurality of through-openings which produce a liquid- and gas-permeable connection between successive channels, and a liquid- and gas-permeable textile mesh, adhesively laminated to the upper surface of the web, and extending across successive channels in the form of a plane, wherein channels in the second group of channels are interrupted by transverse channels open to the underside facing the support plate when in the installed position.

18. Profiled web as claimed in claim 17, wherein the through-openings are constituted by a pattern of stamped openings provided in the film.

19. Profiled web as claimed in claim 17, wherein the through-openings have a shape of an arch when viewed in a direction through the through-openings.

20. Profiled web as claimed in claim 17, wherein the through-openings are of triangular shape when viewed in a direction through the through-openings.

21. Profiled web as claimed in claim 17, wherein the through-openings are of trapezoidal shape when viewed in a direction through the through-openings.

22. Profiled web as claimed in claim 17, wherein the trough portions are of flat construction.

23. Profiled web as claimed in claim 17, wherein the first and-second edge portions of each trough portion extend at right angles thereto.

24. Profiled web as claimed in claim 17, wherein the first and second edge portions of each trough portion extend at an angle of less than 90° thereto.

25. Profiled web as claimed in claim 17, wherein the first and second edge portions of each trough portion extend at an angle of more that 90° thereto.

26. Profiled web as claimed in claim 17, wherein upper surfaces of the transverse channels are situated in a plane with the upper surfaces of the second trough portions.

27. Profiled web as claimed in claim 17, wherein water-permeable flow openings are provided connecting the first group of channels to the transverse channels.

28. Profiled web as claimed in claim 17, wherein a substantially flat profile strip, extending transversely to the channels, is provided at longitudinal ends of the channels.

29. Profiled web as claimed in claim 28, wherein the flat profile strip forms a flat co-planar unit with the first trough portions.

30. Profiled web as claimed in claim 17, wherein the textile mesh is a glass textile mesh.

31. Profiled web as claimed in claim 30, wherein the glass textile mesh has a tear strength between 4000 and 600 kg/lfd.m.

32. Floor covering comprising floor tiles retained adhesively on at least one profiled web, said at least one profiled web being loosely placed on a support plate, said at least one profiled web comprising a rigid plastic film formed to comprise a parallel series of successive channels, each of said channels being defined by first and second edge portions and a trough portion therebetween, the series of channels open alternately to the upper surface of the support plate and to the underside of the floor tiles, trough portions of the channels open to the support plate being parallel and forming an upper surface of the web, and trough portions of the channels open to the tiles being parallel and forming a lower surface of the web, wherein the web is provided with a plurality of through-openings which produce a liquid- and gas-permeable connection between successive channels, and a substantially flat profile strip, extending transversely to the channels, adjacent longitudinal ends of the channels.

33. Floor covering comprising floor tiles retained adhesively on at least one profiled web, said at least one profiled web being loosely placed on a support plate, and said at least one profiled web comprising a rigid plastic film formed to comprise a parallel series of successive channels, each of said channels being defined by first and second edge portions and a trough portion therebetween, the series of channels being open alternately to the upper surface of the support plate as a first group of channels and to the underside of the floor tiles as a second group of channels, first trough portions of the channels open to the support plate being parallel and forming an upper surface of the web, and second trough portions of the channels open to the tiles being parallel and forming a lower surface of the web, wherein the web is with a plurality of through-openings which produce a liquid- and gas-permeable connection between successive channels, and a liquid- and gas-permeable textile mesh, adhesively laminated to the upper surface of the web, and extending across successive channels in the form of a plane, and wherein channels in the second group of channels are interrupted by transverse channels open to the underside facing the support plate.

* * * * *